United States Patent [19]

North

[11] 4,009,678

[45] Mar. 1, 1977

[54] MULTIPLE PUSH-PULL CABLE TRANSMISSION APPARATUS

[75] Inventor: Irving William North, Oshkosh, Wis.

[73] Assignee: Brunswick Corporation, Skokie, Ill.

[22] Filed: Apr. 23, 1975

[21] Appl. No.: 570,716

[52] U.S. Cl. ..... 115/18 R; 74/471 R; 74/480 B; 114/144 R; 180/145

[51] Int. Cl.[2] ..... B63H 5/12

[58] Field of Search ..... 115/18 R, 35; 74/496, 74/501 R, 480 B, 471 R, 388 PS; 180/79.2, 145; 114/163, 144 R

[56] References Cited

UNITED STATES PATENTS

| | | | |
|---|---|---|---|
| 1,777,109 | 9/1930 | Stokes et al. | 180/79.2 R |
| 3,095,849 | 7/1963 | Breunich | 115/18 R |
| 3,237,586 | 3/1966 | Stuteville | 114/163 |
| 3,331,350 | 7/1967 | Norton | 115/18 R X |
| 3,605,932 | 9/1971 | Wilfert et al. | 180/79.2 R |
| 3,631,833 | 1/1972 | Shimanckas | 115/18 R |

*Primary Examiner*—Trygve M. Blix
*Assistant Examiner*—Sherman D. Basinger
*Attorney, Agent, or Firm*—Andrus, Sceales, Starke & Sawall

[57] ABSTRACT

A racing boat is powered by a pair of pendent inboard-outboard drive units having inboard steering arms. A pair of push-pull cable units connect a forward located steering wheel unit to the arms. The cable units extend along opposite sides of the boat with the casing fixed at the steering wheel and the core wires secured to the opposite sides of the steering wheel and to the opposite steering arms. A power steering unit coupled to the one steering arm and having in input element. The adjacent cable unit has a threaded extension pipe with a fixed coupler connected to the power control input. A core rod is connected to the core, is slidably mounted in the pipe and is pivotally connected to the power steering link to transmit casing reaction forces to the power input. An adjustable rigid linkage includes a tie rod having adjustable ends pivotally connected to the anchor member on the extension pipes. The anchor member of the second cable unit is slidably mounted in a pivotally mounted support for generally linear movement. The rod directly interconnects the two anchor members to each other and to the power input for rapid power steering response. A second adjustable tie rod is pivotally connected to the arms and the core wires and is set to properly locate the steering arms.

19 Claims, 6 Drawing Figures

MULTIPLE PUSH-PULL CABLE TRANSMISSION APPARATUS

BACKGROUND OF THE INVENTION

This invention relates to a push-pull cable motion transfer apparatus employing power assists means and particularly to power steering apparatus of such construction for outboard marine drive devices.

Remote transfer of a mechanical motion may be conveniently affected through known push-pull cable assemblies and such systems are widely employed in marine outboard drive systems for water craft, off-road vehicles and equipment and similar applications where a manual input is transmitted to a remote controlled device. For example, as shown in U.S. Pat. No. 3,136,283, a push-pull cable unit interconnects a steering wheel in the forward portion of a boat to a pendant outboard drive secured to the transom of the boat. The pendant outboard drive is mounted to pivot about a vertical axis for steering of the boat. The flexible push-pull cable unit extends between the steering wheel and a pivot arm connected to the pendent outboard drive. The cable unit employs an outer fixed casing or shaft fixedly secured at the opposite ends to the steering wheel support and to the dependent drive support. An inner core means generally a core wire is connected to the steering wheel and moves therewith. The opposite end of the core wire is secured to the pivot arm of the pendent drive.

The outer casing is formed of suitable flexible spring material and will assume a normal straight line condition unless positively curved while permitting guiding of the core about deliberate smooth bends formed in the mounting of the cable means. The casing and core are longitudinally rigid. The core, particularly when large load forces are encountered, is constructed with a high degree of longitudinal rigidity to prevent bending or jamming within the casing.

In many instances, a dual cable system may be employed with a pair of similar push-pull cable units coupled between the opposite sides of the steering mechanism extended along the opposite sides of the boat to the opposite sides of the pendent drive unit to provide a redundancy in the steering mechanism. If one system should fail, the second system maintains the necessary control. For example, in ocean racing, a pair of interconnected, outward drive units are normally employed and the craft may be traveling at speeds in the order of 80 miles per hour over relatively rough seas. It is absolutely essential, for any degree of safety, that steering be constantly maintained. Any significant loss of steering would, of course, result in an extremely dangerous situation.

Further, in applications such as ocean racing, as well as many instances of off-road equipment, relatively heavy steering loads are created. The operating personnel are therefore particularly subject to fatigue and power systems have been suggested and incorporated into the system. A particularly satisfactory power steering system employs a hydraulically activated power means coupled to the pendent drive unit. A pilot or servo valve is coupled to the push-pull cable unit. Generally, and particularly to the outer conduit or casing. The torque reaction on the conduit as a result of the steering and turning forces on the core is transmitted and actuates the servo valve, which, in turn, controls the power steering means.

The push-pull cable means is mounted between the steering means and the power means. As input forces are applied to one end of the core, the load at the opposite end opposes the applied force and creates a reaction force and torque on the casing which is employed to actuate the power means. In the dual steering systems, the core wires are coupled to the opposite sides of the single drive or the interconnected dual drive with a single power assist mounted to the one side of the unit and responsive to torque on the adjacent conduit.

While such power systems reduces the steering loads and minimizes the fatigue resulting from the more conventional push-pull systems, the power systems do not appear to significantly reduce the steering loads encountered in dual cable systems. Even, a single power system does not adequately relieve the fatigue characteristics which inherently includes backlash requiring continuous steering correction. The adjustment of a dual power steering system is quite critical and under operating conditions may ten to come out of adjustment, resulting in a possibly dangerous control situation. Applicant has also found that the dual power systems are not highly responsive under high or heavy load conditions. In particular, in ocean racing with wide open throttle and under heavy seas, the steering is quite non-responsive and demands a high degree of skill and large expenditures of energy on the part of the operating personnel.

SUMMARY OF THE INVENTION

The present invention is particularly directed to a powered multiple push-pull cable unit responsive to the conjoint motion forces of the several cable units. This inventor has discovered certain areas which have contributed to the present functioning and has in accordance with the present invention provided a novel construction which significantly reduces the undesired heavy transfer or steering load at the input of a dual push-pull cable system. The inventor has particularly discovered that the heavy loading effect can be significantly minimized by interconnecting of the conduit anchoring means to each other and to the power steering assist means so as to establish a corresponding control of the power steering means in response to the torque reaction on each one or both of the push-pull cable means. It has particularly been found that this essentially removes the severe loading presently encountered in push-pull cable power steering systems, and thereby eliminates one possible failure condition. The removing of the heavy loading further prevents the critical adjustment characteristic and essentially eliminates changes in the preset adjustment. Finally the minimizing of the steering loads permits the operator to more rapidly and fully control the boat's movement, and substantially minimizes operator fatigue including correction for the backlash inherent in push-pull cable systems. The present invention is applicable to various multiple push-pull cable installations. As the invention has been particularly applied to marine steering systems, the invention is described in connection therewith.

Generally, in dual cable systems employing a power assist means, the large input loading has been found to arise from the fact that the cable unit or means coupled to the power steering means does not become effective until such time as the opposite redundant cable means has been fully loaded. More particularly Applicant has discovered that the core wire of the nonpowered cable unit, even though formed with the usual high degree of rigidity, is stretched or compressed prior to any effective movement occuring on the powered cable unit attached to the power steering unit in such a manner as to operate the servo valve. Thus, although the second cable unit produces the redundancy desired, it, in fact, introduces a relatively large steering load into the system, which is removed by the present inventor. In accordance with the invention, a guide tie means interconnects the cable guides or casings to each other and to the power means to transmit the reaction forces directly to the power input means.

A particularly practical and unique embodiment of the present invention mounts the one cable unit generally as heretofore employed with a threaded extension of the cable guide or casing mounted as a floating coupling or connection to the input of a pilot or servo valve of the power means. The cable core is slidably mounted within the threaded extension member, and coupled at the remote end to the steering arm as a remote load positioning element of the pendent drive unit and to an adjustable rigid linkage means, preferably in the form of a tie rod or bar unit, the opposite end of which is similarly connected to the core of the second cable unit. The adjustable tie bar includes adjustable means to adjust the length thereof for positioning of the pendent drive units relative to each other and to the center of the boat. A casing anchor member is adjustably mounted on the threaded extension and fixed to the pilot or servo valve to form the floating casing connection. In this embodiment the second cable unit includes an anchor member which is slidably mounted in a suitable support. A rigid link, which is preferably adjustable, interconnects the anchor member of the second cable unit directly to the floating casing connection of the first cable unit to directly interconnect the two anchor members to each other, and thereby effect direct transmission of a torque reaction of the second cable unit to the power steering servo valve. Applicant has found that this construction, under actual racing conditions, has resulted in extremely acceptable response with minimum loading by the operator while maintaining a highly improved response characteristic.

Although the invention may operate with a single power steering unit, multiple units can be provided and connected for each of the cable units with the reaction conduits connected in common to each other to maintain common response to each of the power steering assemblies. The invention may also advantageously be applied to a dual steering system, such as a flying bridge and conventional steering station within the boat, where the steering wheels at the stations are interconnected with a third push-pull cable.

Applicant has further found that backlash inherent in push-pull cables creates a lesser or non-responsive system, and thus requires not only additional time but effort in turning of the steering wheel before actual turning occurs. Applicant has found that the response in the steering system can be significantly increased by introducing of the interconnection which places the core wires in tension. As a result, there is a significantly improved response to the movement of the steering wheel. In marine applications where several drives are interconnected a tie bar means is conventionally employed to interconnect the dual drive. The casing tie bar means for an optimum system is constructed with an adjustable connection means which, by proper adjustment provides the desired tensioning of both cable cores to essentially eliminate all backlash and thereby provide essentially instantaneous response.

The present invention permits the adaptation of a highly improved power assist drive means for push-pull cable systems in order to provide essentially instantaneous response with minimum loading of the input means and to minimize the criticality of and variation in the preset adjustment of the total system.

BRIEF DESCRIPTION OF THE DRAWINGS

The drawings furnished herewith illustrate a preferred construction of the present invention in which the above advantages and features are clearly disclosed, as well as others which will be readily understood from the following description of the illustrated embodiment.

In the drawings.

DESCRIPTION OF ILLUSTRATED EMBODIMENT

Figure 1:
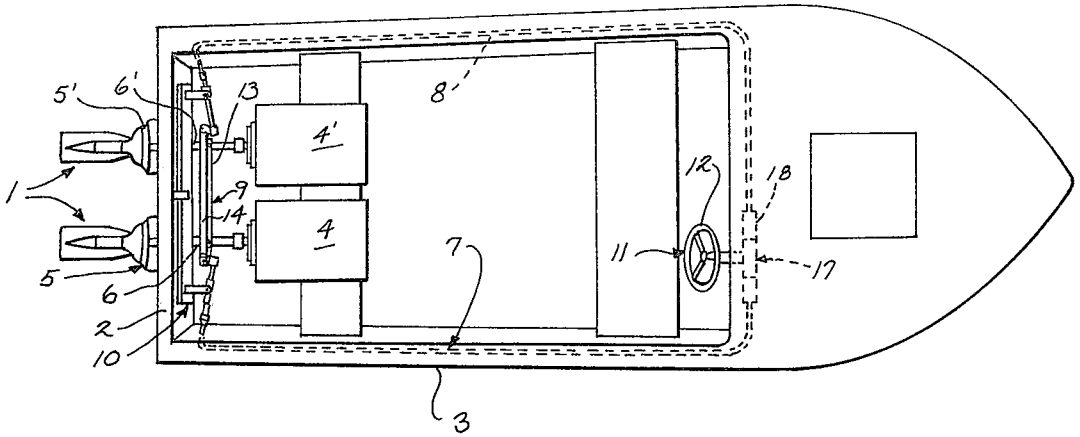
FIG. 1 is a diagrammatic plan view of a water craft with dual inboard-outboard drive, with a dual push-pull cable steering means.
Figure 2:
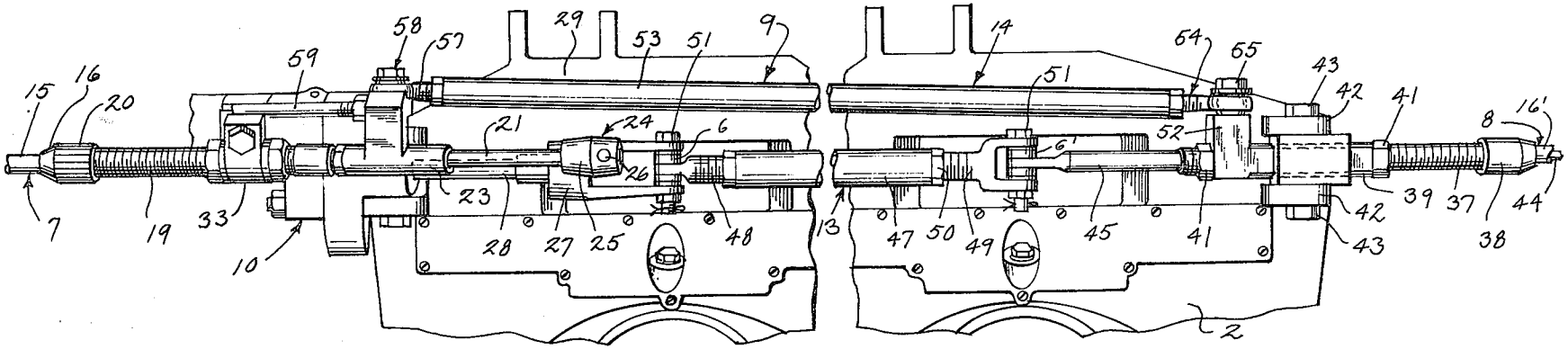
FIG. 2 is an enlarged elevational view of the steering mechanism at the pendent drive units.

Referring to the drawings and particularly to FIG. 1, the present invention is shown applied to a pair of inboard-outboard drive units 1 suspended from the transom 2 of a watercraft or boat 3. The pair of propulsion drive units 1 will be similarly constructed and therefore, a single one of the units 1 is briefly described for purposes of discussion with the corresponding elements of the second propulsion unit identified by corresponding prime numbers.

Propulsion unit 1 is secured to the exterior of the boat transom 2 and projects through an opening therein for drive coupling to a suitable internal combustion engine 4.

The suspension of the propulsion unit 1 generally will include a gimbal ring assembly 5 to permit the pivoting of the unit 1 about a transverse horizontal axis for trim position, and about a vertical axis for steering of the water craft 3. Steering movement of the pendent propulsion unit 1 is through the positioning of a lever arm 6 which projects through the transom 2 and is coupled to a pair of push-pull cable units 7 and 8. A coupling assembly 9 connects arms 6 and 6′ and push-pull cable units 7 and 8 to each other and to a power steering assist means 10, in accordance with the teaching of the present invention, as more fully developed hereinafter. The push-pull cable units 7 and 8 extend forwardly from the assembly 9 within the opposite side walls of the boat 3 to the forward or helm portion where they are suitably coupled to a steering wheel unit 11. The rotation of the steering wheel 12 of the unit 11 correspondingly oppositely actuates the push-pull cable units 7 and 8 to effect a corresponding moving force on the coupling assembly 9 for the pivoting of the steering arms 6 and 6′ for both pendent drive units 1.

In the illustrated embodiment of the invention, a single power steering assist means 10 is mounted as a part of the coupling assembly 9. In accordance with the teaching of the present invention, the assembly 9 further includes a power tie bar means 13 directly connected between the push-pull cable unit 7 and 8 to produce a direct interaction and response of the power steering means to the forces developed in either one or both of the push-pull cable units 7 and 8. As more fully developed hereafter, the unitized or integrated tie bar means 13 significantly minimizes loading of the mechanism while producing essentially instantaneous low power response which can be readily characterized as a "finger-tip" power control for steering of outboard boats and the like. Further, an adjustable steering tie bar means 14 interconnects the pivot arms 6 and 6' and the cable units 7 and 8 for alignment of the pendent units 1 to the boat 3.

More particularly, in the illustrated embodiment of the invention, the cable units 7 and 8 are similarly constructed and the cable unit 7 is described in detail, with corresponding elements of the second cable unit 8 identified by corresponding primed numbers.

The cable unit generally includes an inner core wire 15 slidably disposed with an outer conduit sheath or casing 16. The cable unit 7 extends from the steering wheel 12 where the core wire 15 is suitably connected to the steering wheel 12, for example, by a rack and pinion connection 17 as illustrated in U.S. Pat. No. 3,136,283. The outer casing 16 is immovably fixed to the steering support or fixture 18. The opposite end of the cable unit 7, and particularly the core wire 15 and the casing 16 are connected to one end of the coupling assembly 9, in accordance with conventional practice, immediately adjacent to the power steering assist means 10.

Figures 3, 3A, 4, 5:
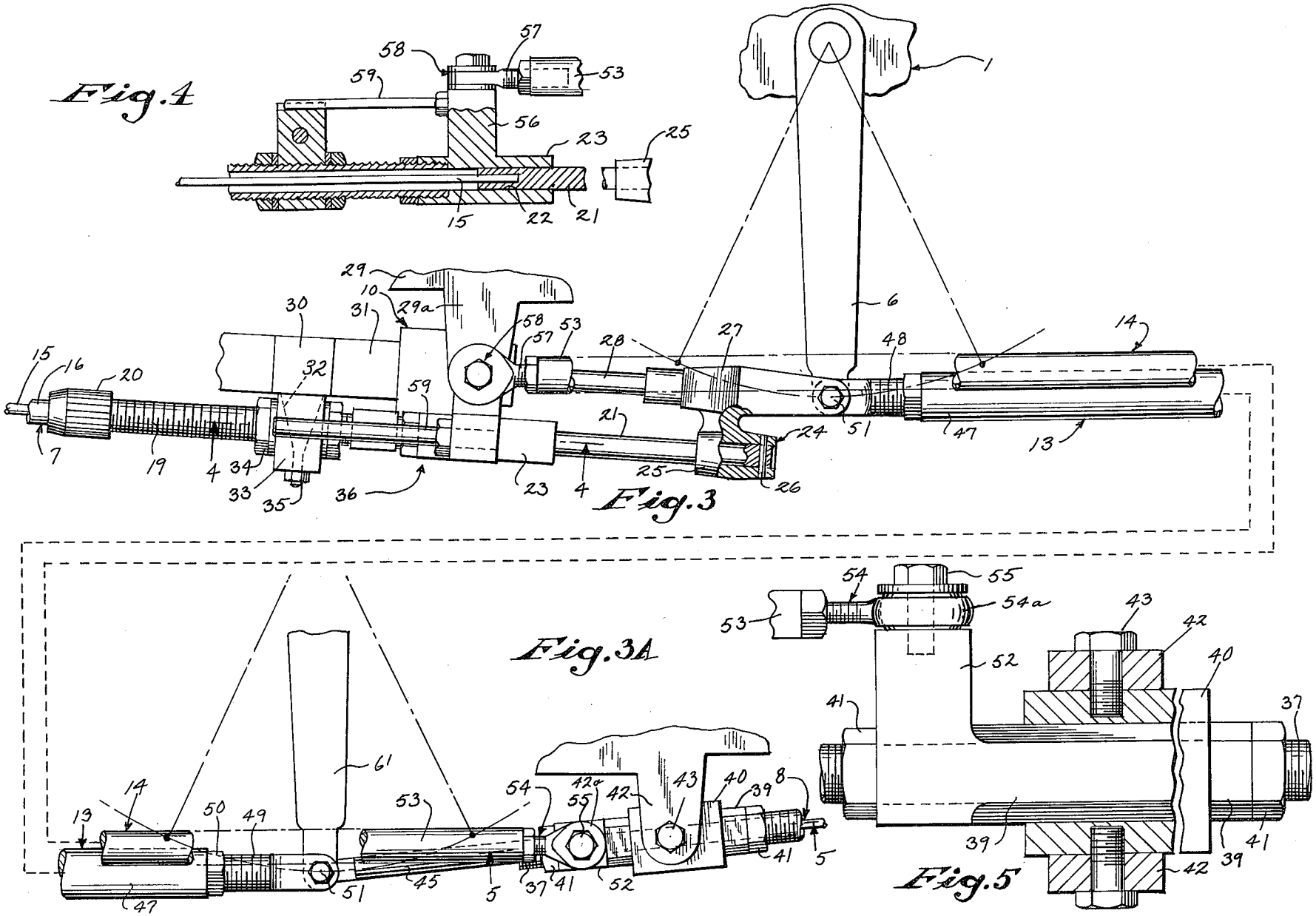
FIG. 3 is a top elevational view of the structure shown in FIGS. 1 and 2.
FIG. 3A is also a top elevational view of the structure shown in FIGS. 1 and 2.
FIG. 4 is a vertical sections taken generally on line 4—4 of FIG. 3.
FIG. 5 is vertical section taken generally on line 5—5 of FIG. 3.

A casing extension tube 19 shown as an exteriorly threaded pipe, is firmly secured to the corresponding adjacent end of the casing by a suitable coupling nut 20 to form a rigid extension thereof. The core wire 15 extends through the threaded pipe 19 and is provided, as shown in FIG. 4, at the outer end with a core wire rod 21. Core wire rod 21 is slidably disposed within a special tubular coupler or casing anchor 23 affixed to and forming an extension of the corresponding outer end of the extension tube or pipe 19. The outer end of the core wire rod 21 is affixed to an end coupling unit 24, which in the illustrated embodiment of the invention includes a coupling cylinder 25 for receiving of the steering core wire rod 21 and a coupling pin 26 extending laterally therethrough. The coupling unit 24 is also pinned to the outer end of the steering pivot arm 6 by a bifurcated link portion 27. Coupling unit 24 is also connected to the operating piston rod 28 of the power steering unit 10 for transmission of assisting forces to the pivot arm 6.

The power steering unit 10 is pivotally mounted to the transom plate 29 by suitable mounting arms or brackets 29*a*. A servo valve 30 actuates a power cylinder 31 with an actuating piston rod 28 extending forwardly into attachment to the coupling unit 24. The power steering servo valve 30 is mounted on the upper portion of the power steering unit 10, and includes an operating member 32 connected to one side thereof, and projecting laterally toward the coupling pipe 19 of the push-pull cable unit 7. A coupling member 33 is located on the pipe 19 and locked in alignment with the operating member 32 of the servo valve 30 by suitable locknuts 34. A nut 35 fastens an operating member 32 to coupling member 33 to affix the first cable unit and particularly the outer casing 16 to the input of servo valve 30. In accordance with known practice, the casing 16 is thereby anchored and supported as a floating assembly 36 with the servo valve 30. Torque reaction forces are created by the push-pull forces applied to the core wire 15 by the steering unit 11 and by the arm 6. The torque reaction forces position operating members 33 and 32 of the servo valve which, in turn, correspondingly actuates the power cylinder 31 to provide automated power steering. The floating assembly 36 is pivotally supported by power unit 10 on the transom plate arm 29*a* which is integrally formed with the transom mounting plate 29 and provides for the steering movement of arms 6 and 6' as shown in FIG. 3.

In accordance with the present invention, the floating assembly 36 of the first push-pull cable unit 7 is firmly affixed to the second cable 8 to establish an interrelated response to forces on the second cable unit as well as the first unit.

In the illustrated embodiment of the invention, the second cable unit 8 is generally similar to the first cable unit, and includes a threaded extension pipe 37 secured to the transom end of the outer cable casing 16' by a conventional coupling nut 38 and forms a rigid interconnection therebetween. A casing anchor 39 is secured to the threaded pipe 37 and slidably mounted within a relatively stationary slide guide 40. The slide guide 40 is provided with a generally rectangular opening, within which the corresponding rectangular portion of the casing anchor 39 is slidably disposed. Suitable locknuts 41 are provided on each end of the casing anchor 39, locking it into position on the threaded pipe 37 for sliding movement within the relatively fixed slide guide 40. The slide guide 40 is pivotally secured on a generally vertical axis between a pair of brackets 42, projecting forwardly from the inner transom plate 29, by suitable pivot bolts 43 which project through the brackets threaded into the top and bottom wall of the slide guide 40. The core wire 15' of the second cable 8 unit extends through pipe 37 and is suitably connected to a core wire rod 45 which is slidably mounted directly in the threaded tube 37, to provide a support generally similar as core wire rod 21 of the first cable unit 7. The outer end of the core wire rod 45 is secured to the bifurcated pivot arm 6' to the second pendent drive unit 1.

The tie bar unit 14 interconnects the steering arms 6 and 6' and steering rods 21 and 45. The tie bar unit 14 generally including a rigid tubular or cylindrical member 47 having the opposite ends thereof oppositely threaded to receive corresponding shafts of coupling bolt members 38 and 49 to form a turn-buckle connection. A lock nut 50 adjustably locks the members 48 and 49 to the tie bar 47 with the outer ends secured to arms 6 and 6'. Member 48 has an eyebolt end pinned to the arm 6 whereas member 49 is a bifurcated member telescoped over and pinned to the arm 6'. Similar connecting bolts 51 project through the arms 6 and 6' and the coupling bolt members and the core wire rods 21 and 45 to pivotally interconnect the elements. The adjustable threaded mounting permits the adjustment of the connection of steering arms 6 and 6' to the rigid tie bar 47 and to cores 15 and 15' to place the pendent drive units 1 in proper alignment with each other and the center line of the boat.

The anchor 39 includes an upstanding bracket or enlargement 52 to which the conduit tie bar unit 13 is secured. Thus, the conduit tie bar unit 13 is also shown including a tubular member 53 having the opposite ends internally threaded. An eyebolt member 54 includes a shank threaded into the end of the tubular member 53 adjacent to the casing anchor 39 of the second push-pull cable unit. The member 54 includes an inner circular inner bearing portion 54*a* abutting the flat, top wall of the enlargement 52. An anchor bearing bolt 55 clamps the eyebolt 54 to the upper surface of the slide guide enlargement 52 to provide a firm connection therebetween. The member 53 extends across the transom plate 29 of the pendent units 1, with the opposite end thereof secured to coupler member 23 of the floating assembly 36 as previously described with the first push-pull cable unit 7. The coupler 23 further includes an integral or rigidly affixed upstanding enlargement 56, the upper end of which generally terminates in a flat surface. The adjacent end of the tubular member 53 includes an adjustable tie bolt 57 secured thereto and affixed by anchor bearing bolt assembly 58. The bolt members 54 and 57 have opposite hand threads and with tubular member 53 forms a turnbuckle connection. The enlargement 56 is the same construction as the opposite end connection of the member 53 to the coupler enlargement 52. Rotation of coupler member 23 is prevented by a stabilizer rod member 59 secured to member 56. The member 53 is rotated to contract and pull on the push-pull cable conduits 16 and 16' which are fixed at the steering assembly 11. The reaction on the core wires 15 and 15' causes them to move in the opposite direction. As the core wires are connected by tie bar unit 14, the core wires are placed in tension. This essentially eliminates the backlash normally encountered in a push-pull cable unit such as conventionally employed in steering systems. The tension stressing is desirable because the core wires are generally stronger in tension than in compression.

The conduit extension pipe 19 of the push-pull cable unit 7 is mounted as the floating assembly 36 with the input of the power steering unit 10. The floating assembly 36 is further rigidly affixed through the coupler or anchor members 52 and 56 and member 53 to the opposite slide member 39, and thus to the outer casing extension 37 of the second push-pull cable unit 8. The essentially rigid linkage between these elements provides for a corresponding positioning of the several elements, such that the torque reaction on either one or both of the push-pull cable units 7 and 8 is correspondingly and simultaneously applied to the power steering unit 10. Thus, the push-pull cable units necessarily function with the core wires 15 and 15' moving in opposite directions in response to a force at the steering wheel 12 or on the pendent unit arms 6 and 6'. Consequently, the direction of the reaction of the casings or conduits 16 and 16' will be the same with respect to the power steering unit 10 which is secured to the transom.

The coupling member 39 is slidably mounted to permit the necessary movement with the outer conduit 16' of cable unit 8. This permits the rigid connection to the power steering input element which must move to operate the power steering unit. In addition, the initial tension adjustment movement is accommodated by the sliding movement of the coupling member 39. This permit the rigid interconnection as shown and described with the improved power steering functioning.

The pivotal interconnection between the member 53 and the anchor members 52 and 56, as well as the pivotal connection within the coupling assembly 9, permits the required movement of the assembly with the pendent units 1 while maintaining the transfer of the torque reaction forces on the casings to the power steering mechanism.

The adjustable construction of the core wire tie bar unit 14 and of the casing tie bar unit 13 as well as the securement to the conduit extension tubes permit accurate setting and locking of the mechanism in predetermined coupled relationship. The steering forces in the tensioned core wires 15 and 15' are essentially instantly transmitted from the steering mechanism through the push-pull cable to the floating coupling assembly 36. They further are essentially instantly reflected in a torque reaction force applied to the power steering mechanism, which thus affects the actual steering and essentially eliminates all heavy loading on the floating coupling assembly 36 and the push-pull cable units 7 and 8. The system minimizes the danger of breakage within the steering linkage coupling as a result of the reduced loading and further significantly reduces the work load of the operator, thereby reducing fatigue. The essential elimination of the heavy or severe loading within the linkage also minimizes the normal movement within the adjustable connections and thus maintains the desired steering characteristics. Thus once the linkage has been properly adjusted, it will not readily come out of adjustment. The dual steering system maintains the highly desirable redundancy with the associated safety, which is, of course, particularly required in applications such as racing and the like.

This invention has been illustrated in an assembly employing a single power steering unit. Power steering units can be provided, and coupled with each of the push-pull cable sheaths or casings in combination with a suitable rigid linkage between the casing units and the individual power steering valves to maintain the desired conjoint interaction and response in accordance with the teaching of this invention.

The present invention thus provides a highly improved dual steering mechanism, particularly adapted to power steering control. The invention can be readily applied with existing power steering mechanism thus providing a very simple and economical application in well-known push-pull cable motion transfer mechanism.

Various modes of carrying out the invention are contemplated as being within the scope of the following claims particularly pointing out and distinctly claiming the subject matter which is regarded as the invention.

I claim:

1. In a powered mechanical motion transmission apparatus having oppositely movable input means for controlling a remote positioning element means through a first and a second push-pull means, each of said push-pull means including an outer guide means and an inner movable core means and having the guide means fixedly mounted at the first end and having means connecting the first end of the core means of the first and second push-pull means to the movable input means for opposite movement of the core means in response to a given movement of the movable input means, means connecting the opposite end of the core means to said remote positioning element means, a power means having a power input means, each of said core means establishing reaction forces on the corresponding guide means as a result of the movement of the core means, the improvement in the coupling of the guide means to the power input means comprising guide tie means interconnecting the power input means of said power means and each of the guide means of the first and second push-pull means, said guide tie means establishing a rigid interconnection therebetween to transmit all reaction forces of both of the said guide means to the power input means and thereby establish rapid response to any of said reaction forces on said guide means of both said first and second push-pull means.

2. In the powered mechanical motion transmission apparatus of claim 1 wherein said core means are elongated wire-like elements, a tie bar means connects said wire-like elements to each other and forms a rigid connection therebetween, and said tie bar means includes adjustable means to adjust the length of the tie bar means and preset said core means in tension.

3. In the mechanical motion transmission apparatus of claim 1 wherein said positioning element means includes a plurality of correspondingly movable elements spaced in a common plane of movement and having core tie means connecting said elements, said inner movable core means of said first and second push-pull means being connected one each to each of said movable elements, said power means being mounted adjacent one of said elements and the first of said push-pull means and with the power input means coupled to the adjacent guide means, said tie means including an anchor means secured to the guide means of the first push-pull means and movable therewith, a second anchor means secured to the guide means of the second push-pull means and movable therewith, a guide having said second anchor means slidably mounted therein, and a rigid linkage connected to said first and second anchor means to transmit the forces therebetween and thereby transmit reaction forces on said second guide means directly to the power input means.

4. The transmission apparatus of claim 3 wherein said inner movable core means are elongated wire-like elements and said core tie means includes adjustable means to adjust the length of the core tie means and preset said core means in tension.

5. In a powered mechanical motion transmission apparatus having oppositely movable input means for controlling a plurality of remote positioning load elements through a first and a second push-pull flexible cable means, each of said cable means including an outer flexible casing and an inner movable core wire of a high degree of longitudinal rigidity to transmit forces therethrough, said casing being fixedly mounted at the movable input means and having means connecting the first ends of the core wires of the first and second push-pull cable means to the movable input means for opposite movement of the core wires in response to a given movement of the input means, core wire connection means connecting the opposite ends of the core wires to first and second inputs of said remote positioning load elements, a power means coupled to position said load elements and having an input control means and adapted to be connected to the casing of a push-pull cable means and responsive to the reaction forces exerted on such casing as a result of the movement of the core wire, the improvement comprising casing tie bar means including a rigid linkage connecting the input control means of the power means to the casings of the first and the second push-pull cable means, said rigid linkage providing for direct transmission of all reaction forces of both of said casings to the power input control means and thereby establish rapid response to said forces.

6. The powered mechanical motion transmission apparatus of claim 5 wherein said rigid linkage includes an adjustable link means to adjust the length of the rigid linkage and presetting of the tension of said core wires.

7. The powered mechanical motion transmission apparatus of claim 5 wherein said power means includes a single power unit having its input means connected to the casing of the first push-pull cable means, and said rigid linkage being connected to said last named casing to transmit the force of the second push-pull cable means to the power unit.

8. The motion transmission apparatus of claim 5 having a power coupler means secured to said first casing in alignment with and connected to the power input control means, said casing tie bar means including an anchor member secured to said power coupler means, a rigid link member having end connecting elements at least one of which is adjustable, said one end connecting element being attached to said anchor member, an anchor slide guide, an anchor member slidably mounted in said guide and firmly attached to said casing of said second cable means, the second of the end connecting elements of the rigid link member being attached to the anchor member for said second push-pull cable means.

9. The motion transmission apparatus of claim 8 wherein each of the push-pull cable means includes a threaded tubular extension member affixed to the corresponding casing of the push-pull cable means and extending outwardly therefrom, an extension rod slidably mounted in the tubular extension member and secured at the inner end to the corresponding core wire of the push-pull cable means, said power coupler means being connected to the tubular extension member of the first push-pull cable means, said anchor members being connected to the tubular extension members.

10. The motion transmission apparatus of claim 8 wherein said second anchor member and said slide guide having corresponding essentially rectangular mating configurations to support said anchor member for sliding movement in response to torque reaction on the casing of the second cable means in response to force on the core wire of the second push-pull cable means.

11. The motion transmission apparatus of claim 5 wherein the first push-pull cable means includes a tubular member affixed to the casing of the first push-pull cable means and extending outwardly therefrom, an extension rod slidably mounted to the tubular member and secured at the inner end to the core wire of the first push-pull cable means, a power coupler means connected to the tubular member and to the input control means of the power means, a connector means connected to the outer end of the extension rod and the first positioning load element, said casing tie bar means including an anchor member secured to said tubular member and having a bracket portion, said casing tie bar means including a rigid link member and having end connecting members threadedly connected to the opposite ends of the link member, a second tubular member fixed to the second cable casing of the second push-pull cable means, a second extension rod slidably mounted in said second extension tubular member and secured at the inner end to the core wire of the second push-pull cable means, a second connector means connected to the outer end of said second extension rod and to said second remote positioning element, means rigidly connecting said first and second positioning elements, an anchor slide guide, a second anchor member slidably mounted in said guide and affixed on said second tubular member, said second anchor member including an upstanding anchor bracket portion, and a means pivotally attaching said end connecting members to the anchor bracket portions of said first and second push-pull anchor members.

12. The motion transmission apparatus of claim 5 wherein said positioning load elements include a pair of pivoting arms having spaced parallel axis and connected one each to the core wires of the first and second push-pull cable means, said core wire connection means including first and second core wire extension rod members connected to the core wires of the first and second push-pull flexible cable means and slidably mounted in corresponding first and second support members, pivotal support means connected to said support members and located to pivot with the rod members and pivoting arms, said casing tie bar means including a rigid link member pivotally connected at the opposite ends to said support members with the pivot connection on the same radius with respect to said pivotal support means for said support members.

13. The motion transmission apparatus of claim 12 wherein said pivotal support means includes first and second spaced pivot brackets located outwardly of said arms, said first support member including the power means and being pivotally mounted upon said first bracket and supporting the corresponding end of the push-pull cable means, said pivotal support means including a slide guide pivotally mounted upon said second bracket, and said second support member being slidably mounted within said slide guide for rectilinear movement therein.

14. The apparatus of claim 13 wherein said casing tie bar means includes anchor members affixed to said support members, said anchor members including bracket portions having coplanar upper walls, said casing tie bar means including a rigid elongated member having adjustable end connectors pivotally connected to said bracket portions.

15. The motion transmission apparatus of claim 5 wherein a threaded extension tube member is affixed to the casing of the first push-pull cable means and extends outwardly therefrom, an extension rod is slidably mounted in the tube member and secured at the inner end to the core wire of the first push-pull cable means, a pivotal mounting for said power means, a connector means connecting the power means and the extension rod to the first positioning element, an input coupler on said tube member in alignment with and connected to the power input control means, said casing tie bar means including an anchor member threaded onto said tube member and locked in position thereon, said anchor member including an upstanding bracket having an upper flat wall, said casing tie bar means further including a rigid tubular member having interiorly threaded opposite ends, a first eyebolt member having a threaded shank threaded into the first end of the rigid tubular member, a second threaded extension tube member fixed to the second cable casing of the second push-pull cable means, a second extension rod slidably mounted in said second extension tube and secured at the inner end to the core wire of the second push-pull cable means, a second connector means connected to the outer end of said second extension rod and to said second positioning element, an anchor slide guide pivotally mounted, a second anchor member slidably mounted in said guide and threaded onto said second extension tube member and locked into position thereby, said second anchor member including an upstanding anchor bracket terminating in an upper flat wall, a second eyebolt member having a threaded shank threaded into the second end of the rigid tubular member, and bearing bolt means pivotally mounting said eyebolt members to the upper flat walls of said mounting brackets.

16. The motion transmission apparatus of claim 15 wherein said second anchor member and said slide guide having corresponding essentially rectangular mating configurations to support said anchor member for sliding rectilinear movement in response to the torque reaction on the casing of the second cable means in response to force on the core wire of the second push-pull cable means.

17. A power steering mechanism for an outboard driven watercraft including a pair of transom-mounted pendent outboard drive units each of which includes a pivotal steering arm extending through the transom of the boat and having a steering means provided at the helm portion of the watercraft and connected to control the steering arms of the pendent units by simultaneously oppositely actuating a first and second push-pull cable means, said cable means each having an outer casing and an inner core wire, the improvement in the interconnection of the core wires of the push-pull cable means one each to each of said first and second pivot arms of the pendent drive units, comprising a power steering control means having a pivotal mounting means and including a pivotal coupling to one of said steering arms, said power steering control means having an input, an adjustable tension bar interconnected between said pivot arms and preset to place the core wires under tension for all positioning of the push-pull cable means, and rigid coupling means connected to the input of the power steering means and to each of the casings of the push-pull cable means to transmit reaction forces directly to the power steering control means from either or both of said casings.

18. The power steering mechanism of claim 17 wherein said rigid coupling means includes a pair of rigid tubular casing extensions secured one each to each of said casings, anchor means connected to said extensions, and a rigid link means pivotally interconnected to said anchor means of said cable means to provide a rigid interconnection with essentially instantaneous operation of the power steering control means in response to reaction forces on both of said push-pull cable means.

19. The apparatus of claim 17 having a transom mounting member and wherein said casing of the first cable means is affixed to the input of the power steering means, said coupling means including an anchor means secured to the second casing of said second push-pull cable means, a guide member for said anchor means having a pivotal mounting means secured to the transom mounting member, said anchor means being slidably disposed within said guide member for sliding movement therein in response to torque reaction forces on the second casing.

* * * * *